US009427804B2

(12) United States Patent
Sun

(10) Patent No.: US 9,427,804 B2
(45) **Date of Patent: *Aug. 30, 2016**

(54) METHOD FOR PRODUCING A HIGH-PERFORMANCE NEODYMIUM—IRON—BORON RARE EARTH PERMANENT MAGNETIC MATERIAL

(71) Applicant: China North Magnetic & Electronic Technology Co., LTD, Shenyang, Liaoning (CN)

(72) Inventor: Haotian Sun, Liaoning (CN)

(73) Assignee: China North Magnetic & Electronic Technology Co., LTD, Shenyang, Liaoning (CN)

( * ) Notice: Subject to any disclaimer, the term of this patent is extended or adjusted under 35 U.S.C. 154(b) by 421 days.

This patent is subject to a terminal disclaimer.

(21) Appl. No.: 14/049,849

(22) Filed: Oct. 9, 2013

(65) Prior Publication Data

US 2014/0328711 A1 Nov. 6, 2014

(30) Foreign Application Priority Data

May 5, 2013 (CN) ..... 2013 1 0160441

(51) Int. Cl.

| | |
|---|---|
| ***B22F 3/087*** | (2006.01) |
| ***B22F 3/10*** | (2006.01) |
| ***B22F 9/04*** | (2006.01) |
| ***C22C 1/10*** | (2006.01) |
| ***H01F 1/057*** | (2006.01) |
| ***B22F 1/00*** | (2006.01) |
| ***B22F 9/02*** | (2006.01) |

(52) U.S. Cl.

CPC ..... *B22F 1/0081* (2013.01); *B22F 9/023* (2013.01); *C22C 1/1084* (2013.01); *H01F 1/0577* (2013.01); *B22F 2998/10* (2013.01); *C22C 2001/1089* (2013.01); *H01F 1/0573* (2013.01)

(58) Field of Classification Search

CPC ..... B22F 3/087; B22F 3/10; B22F 9/023; B22F 9/04; B22F 2998/10; B22F 2009/044; C22C 1/1084; H01F 1/0573; H01F 1/0577

USPC ..... 419/19, 20; 420/416; 75/233; 252/62.55; 148/101, 301, 306

See application file for complete search history.

(56) References Cited

U.S. PATENT DOCUMENTS

| | | | | |
|---|---|---|---|---|
| 5,034,146 | A * | 7/1991 | Ohashi | H01F 1/0577 148/101 |
| 6,461,565 | B2 | 10/2002 | Tokuhara et al. | |
| 6,491,765 | B2 | 12/2002 | Okayama et al. | |
| 6,527,874 | B2 | 3/2003 | Li | |
| 6,537,385 | B2 | 3/2003 | Okayama et al. | |
| 9,005,374 | B2 * | 4/2015 | Ozeki | B22F 1/02 148/101 |
| 2008/0247898 | A1 * | 10/2008 | Nakamura | B22F 3/24 419/9 |
| 2012/0280775 | A1 * | 11/2012 | Nagata | H01F 41/0293 335/302 |
| 2014/0327195 | A1 * | 11/2014 | Sun | C21D 9/0031 266/250 |
| 2014/0328712 | A1 * | 11/2014 | Sun | H01F 41/0293 148/101 |
| 2014/0328713 | A1 * | 11/2014 | Sun | H01F 1/0577 419/29 |
| 2015/0243433 | A1 * | 8/2015 | Sun | B22F 9/04 148/102 |
| 2015/0248968 | A1 * | 9/2015 | Sun | H01F 1/0577 419/28 |

FOREIGN PATENT DOCUMENTS

| | | |
|---|---|---|
| CN | 1195600 C | 9/2001 |
| CN | 1272809 C | 11/2001 |
| CN | 1182548 C | 2/2002 |

* cited by examiner

*Primary Examiner* — Helene Klemanski

(57) ABSTRACT

In the method for producing a high-performance neodymium-iron-boron rare earth permanent magnetic material of the present invention, the degree of alignment of the magnet can be improved by preparing the pre-sintered alloy material, the particle size of the powder ground by the jet mill can be refined and the fine powder in the filter of the jet mill can be mixed with the powder collected by the cyclone collector by controlling the oxygen content of the jet mill and adding the nanoscale oxide fine powder. The present invention can significantly improve the utilization ratio of the material and the performance of the magnet, save the use of the rare earth, and especially the heavy rare earth, thereby protecting the scare resources.

11 Claims, No Drawings

METHOD FOR PRODUCING A HIGH-PERFORMANCE NEODYMIUM—IRON—BORON RARE EARTH PERMANENT MAGNETIC MATERIAL

BACKGROUND OF THE PRESENT INVENTION

1. Field of Invention

The present invention belongs to a permanent magnetic material field, and more particularly to a method for producing a high-performance neodymium-iron-boron rare earth permanent magnetic material.

2. Description of Related Arts

Due to the excellent magnetic properties, the neodymium-iron-boron rare earth permanent magnetic material is getting more and more applications and has been widely used in the medical magnetic resonance imaging, the computer hard disk drive, the sound, the mobile phone and so on. With the energy-saving and low-carbon economy requirements, the neodymium-iron-boron rare earth permanent magnetic material began to be applied in the auto parts, the household appliances, the energy-saving and control motors, the hybrid electric vehicles, the wind power and other fields.

In 1982, Japan Sumitomo Special Metals Company firstly disclosed the Japanese patent Nos. 1,622,492 and 2,137,496 about the neodymium-iron-boron rare earth permanent magnetic material, and then the U.S. patent and European patent are applied, which disclosed the characteristics, components and manufacturing method of the neodymium-iron-boron rare earth permanent material, and confirmed the main phase: Nd2Fe14B phase, the grain boundary phase: Nd-rich phase, B-rich phase and the rare earth oxide impurities.

On Apr. 1, 2007, Japan Hitachi Metals Company was merged with Japan Sumitomo Special Metals Company, and inherited the patent license right and obligation about the neodymium-iron-boron rare earth permanent magnet of the Sumitomo Special Metals Company. On Aug. 17, 2012, the Hitachi Metals Company brought a lawsuit to the U.S. International Trade Commission (ITC) that it had the patent right of U.S. Pat. No. 6,461,565, U.S. Pat. No. 6,491,765, U.S. Pat. No. 6,537,385 and U.S. Pat. No. 6,527,874.

The filing date of the U.S. Pat. No. 6,461,565 is May 8, 2001, the corresponding Chinese patent application number is CN1195600C, this patent believes that it is difficult to have the magnetic compaction under the protective atmosphere, this application claimed the magnetic compaction under the atmosphere, the working temperature is larger than 5° C. and smaller than 30° C., and the relative humidity is between 40% and 65%. The powder is compacted under this environment.

U.S. Pat. No. 6,491,765 filed on May 9, 2001 and U.S. Pat. No. 6,537,385 filed on Jul. 9, 2001 filed a Chinese patent No. CN1272809C, this patent claimed that the powder is prepared by the inert gas jet mill with the oxygen content is 0.02-5%, at least a part of ultra-fine powders with the particle size of less than 1 μm are removed by the cyclone collector, thus the total amount of the ultra-fine powders with the particle size of less than 1 μm in the powder is controlled to less than 10%. The jet mill uses the cyclone collector to collect the powder, so a part of the particles with the size of less than 1 μm discharged along the airflow is the natural process.

Japan Hitachi Metals Company filed a U.S. Pat. No. 6,537,874 on Jul. 10, 2001, and a Chinese Patent No. CN1182548C claimed a strip casting technology of a neodymium-iron-boron rare earth permanent magnetic alloy melting process at least containing the metal element Nb or Mo.

SUMMARY OF THE PRESENT INVENTION

With the application market enlarge of the neodymium-iron-boron rare earth permanent magnetic material, the rare earth resource shortage is getting worse, and especially for the application in the electronic components, the energy conservation and control of motor, the auto parts, the new energy vehicles, the wind power generation and other fields, more heavy rare earth are needed for improving the coercivity. Therefore, how to reduce the use of the rare earth, and especially the use of the heavy rare earth, is the important issue placed in front of us. By exploring, a high-performance neodymium-iron-boron rare earth permanent magnetic material and a method for producing the same are found.

The present invention is achieved by the following technical solutions:

The neodymium-iron-boron rare earth permanent magnetic material is the alloy magnet of R—Fe—B-M and R—Fe—Co—B-M, and R denotes one or more rare earth elements, M denotes one or more elements of Al, Nb, Ga, Zr, Cu, V, Ti, Cr, Ni, Hf, Ta, W, Mo, S, C, N and O.

The manufacturing method of the present invention is completed according to the following processes:

1. Alloy Melting Process

The alloy melting method adopts a vacuum induction melting, the alloy is cast on the water-cooled rotary roller by the tundish, the molten alloy forms the alloy sheet after the rotary roller cooling, the alloy sheet falls on the rotary table after leaving the rotating copper roller, the rotary table is located below the copper roller, the alloy sheet is secondarily cooled by the inert gas cooling device with the heat exchanger and the mechanical stirring device.

2. The Coarse Pulverization Process

In the coarse pulverization process, the previous alloy sheet or ingot is firstly put to the vacuum hydrogen pulverization furnace, the furnace is charged with hydrogen after being vacuumed for hydrogen adsorption of the alloy in the vacuum hydrogen pulverization furnace, the temperature of the hydrogen adsorption is generally lower than 200° C., the pressure of the hydrogen adsorption is generally 50-200 KPa, after the hydrogen adsorption is completed, the furnace is vacuumed and heated dehydrogenated, the temperature of the dehydrogenation is generally 600-900° C., the powder is cooled after dehydrogenation under the vacuum or protective atmosphere, the protective atmosphere is generally argon.

One improved coarse pulverization method is that the alloy ingot or sheet is put into the rotary drum, the drum is vacuumed and charged with hydrogen for hydrogen adsorption, after the hydrogen adsorption is saturated, the hydrogen is stopped for 10 minutes, and then the drum is vacuumed, heated and rotated for dehydrogenation, the dehydrogenation is under the vacuum, the temperature of the dehydrogenation is 600-900° C., the drum is cooled after dehydrogenation.

Another improved coarse pulverization method is a rare earth permanent magnetic alloy hydrogen pulverization continuous production method and apparatus. The apparatus consists of the hydrogen adsorption chamber, the heating dehydrogenation chamber, the cooling chamber, the indoors isolation valve, the feed box, the transmission device and the vacuum device; the hydrogen adsorption chamber, the heating dehydrogenation chamber and the cooling chamber are connected with each other by the indoors isolation valves, the transmission device is located above the hydrogen adsorption chamber, the heating dehydrogenation chamber and the cooling chamber, the feed box is hanged above the transmission device, and conveyed along the transmission device followed by the hydrogen adsorption chamber, the heating dehydrogenation chamber and the cooling chamber; while working, the alloy is firstly put into the hanging basket, the basket containing the alloy is sent to the hydrogen absorption chamber, the dehydrogenation heating chamber and the cooling chamber in accordance with the order by the hanging drive means for absorbing the hydrogen, heating dehydrogenating and cooling; the alloy is put into the material storage tank under the vacuum or protective atmosphere.

3. Jet Mill Powder Production Process

The powder is prepared by the jet mill, the jet mill mainly consists of the feeder, the grinding chamber with the nozzle at the lower portion thereof and the sorting wheel at the upper portion thereof, the weighing system for controlling the powder weight in the grinding chamber and the feeding rate, the cyclone collector, the powder filter, and the gas compressor, the working gas is generally nitrogen, the pressure of the compressed gas is 0.6-0.8 MPa; while working, the previous powder is firstly added to the feeder of the jet mill, the powder is added to the grinding chamber under the control of the weighing system, the powder is ground by the high speed airflow jetted by the nozzle, the ground powder rises with the airflow, the powder reaching the production requirement is collected by the cyclone collector via the sorting wheel, the coarse powder without reaching the production requirement returns to the lower portion of the grinding chamber under the effect of the centrifugal force for continuous grinding; the powder into the cyclone collector as the product is collected in the material receiver at the lower portion of the cyclone collector. The cyclone collector can not collect all powder, few fine powders are exhausted with the airflow, and these fine powders are filtered by the filter and collected in the fine collector at the lower portion of the filter. In general, the proportion of the fine powder is lower than 15% of the powder weight, the particle size is lower than 1 μm, the rare earth content of this powder is higher than the average rare earth content of the powder, and is easy to be oxidated and thrown away as the waste powder.

One improved jet mill powder production technology is that the oxygen content of the atmosphere is controlled to be lower than 50 ppm and the temperature of the grinding powder is controlled to be lower than 50° C. for avoiding the oxidation of the fine powder, this fine powder and the powder collected by the cyclone collector are added into the two-dimensional or three-dimensional mixer for mixing, and then the magnetic compaction is formed under the protective atmosphere; the mixing time is general more than 30 minutes, the oxygen content in the mixing atmosphere is lower than 150 ppm.

4. The Magnetic Compaction Process

The maximum difference between the neodymium-iron-boron permanent magnetic compaction and the common powder metallurgy compaction is the compaction under the alignment magnetic field. Therefore, the electromagnet is designed on the press machine. The neodymium-iron-boron rare earth permanent magnetic powder is easy to be oxidated, some patents put forward that while compaction, the environmental temperature should be in the range of 5-35° C., the relative humidity should be in the range of 40%-65%, the oxygen content should be in the range of 0.02-5%. To avoid the powder oxidation, one improved magnetic compaction technology is that a protection box is designed, the glove is designed on the protection box, and the powder forms the magnetic compaction under the protective atmosphere. A further improved technology is that the cooling system is designed in the magnetic space of the protection box, the temperature of the magnetic compaction space can be controlled, the mold is placed in the low-temperature space with the controllable temperature, the powder is compacted under the controllable temperature, the controllable temperature is −15-20° C., preferably, the compaction temperature is lower than 5° C.; the oxygen content in the protection box is lower than 200 ppm, preferably, 150 ppm; the alignment magnetic strength in the compaction cavity is generally 1.5-3 T, the magnetic powder is pre-aligned before being pressed and the alignment magnetic strength is maintained during the pressed process; the alignment magnetic field is the constant or pulsating or alternating. To reduce the compaction pressure, the powder is isostatically pressed after the magnetic compaction, and then is sent to the sintering furnace for sintering.

5. Sintering Process

Sintering is after the compaction and completed in the vacuum sintering furnace under the vacuum or protective atmosphere, the protective gas is argon; the sintering temperature is 1000-1200° C., the holding time is generally 0.5-20 hours, the powder is cooled by argon or nitrogen after heat preservation. The improved sintering method and equipment is that a valve and a transfer box with the glove are located in front of the vacuum sintering furnace, the compacted material block is sent to the transfer box under the protective atmosphere, the protection box is charged with the protective gas, the external package is removed and the material block is put into the sintering feed box under the protective atmosphere, and then the valve between the transfer box and the sintering furnace is open, the feed box containing the sintering material block is sent to the vacuum sintering furnace by the transmission mechanism in the transfer box for sintering. The further improved technique adopts the multi-chamber vacuum sintering furnace to sinter, dehydrogenation, sintering and cooling are respectively completed within different vacuum chambers, the transfer box with the glove is connected with the vacuum chamber by the valve, the feed box passes through a plurality of vacuum chambers orderly; the sintered compact is regarded as the pre-sintered alloy material, the sintering temperature is controlled to 850-900° C. for secondary hydrogen pulverization. Compared with the melting alloy, the grain alignment of the pre-sintered alloy material is obviously higher than that of the melting alloy, which is the key to improve the performance of the magnet; in spite of increasing the manufacture cost, the use of the heavy rare earth is obviously reduced, thereby bringing to the significant economic benefits.

6. Secondary Hydrogen Pulverization

The above-mentioned coarse pulverization can be applied to the secondary hydrogen pulverization; the preferable hydrogen pulverization process is that the alloy sheet is put into the hanging basket, the basket containing the alloy is sent to the hydrogen absorption chamber, the dehydrogenation heating chamber and the gas cooling chamber of the continuous vacuum hydrogen pulverized furnace in accordance with the order by the hanging drive means for absorbing the hydrogen, heating dehydrogenating and cooling, and then the alloy is put into the material storage tank under the vacuum or protective atmosphere.

7. Mixing and Secondary Powder Production

Firstly, the secondarily hydrogen pulverized powder and one or more powders selected from the group consisting of lanthanum oxide, cerium oxide, praseodymium oxide, neodymium oxide, dysprosium oxide, yttrium oxide, iron oxide, titanium oxide, zinc oxide, aluminum oxide and zirconium oxide are evenly mixed, and then the powder is prepared by the jet mill, the jet mill powder production process is the same as the above-mentioned jet mill powder production, the oxygen content in the atmosphere of the jet mill is lower than 50 ppm; the mixing time is generally more than 30 minutes, the oxygen content in the mixing atmosphere is lower than 150 ppm, the average particle size of the nanoscale oxide fine powder is 20-40 nm. The average particle size of the powder collected by the cyclone collector is 0.8-3.0 μm; while powder production, the nanoscale oxide fine powder adsorbs on the surface of the freshly pulverized particle for avoiding the further oxidation of the particle, the nanoscale oxide fine powder is presented in the grain boundary while sintering, the grain is inhibited from abnormal growth, the shortage of the grain boundary phase can be improved, involved in the combination of the grain boundary phase, the corrosion resistance and the mechanical performance of the magnet are improved.

8. Secondary Magnetic Compaction

The secondary magnetic compaction process is under the protection of nitrogen, the oxygen content in the protection box is lower than 150 ppm, the compaction temperature is lower than 5° C., and the compact is packaged after the magnetic field orientation compaction and then removed from the protective box for isostatic pressing.

9. Secondary Sintering Process

The secondary sintering process is that under the condition of isolating from the atmosphere, the compact with the internal packing is sent to the transfer box with gloves of the protecting feed vacuum sintering furnace after isostatic pressing, the compact is put into the sintering feed box after the packing of the compact is removed under the protective atmosphere, and then the valve of the protecting feed vacuum sintering furnace is open, the feed box with the compact is automatically sent to the sintering chamber of the protecting feed vacuum sintering furnace by the transfer skip in the transfer box for vacuum or protective atmosphere sintering; and the sintering temperature is in the range of 950-1050° C.

10. Machining and Aging

In the machining and aging process, the sintered compact is machined according to the final size or approximately final size of the piece, the compact is made the high-temperature aging treatment and the low temperature aging treatment after machining; the high-temperature aging temperature is in the range of 850-950° C., the low-temperature aging temperature is in the range of 450-650° C., the feed material is generally machined and surface treated after aging.

By improving the method of producing the neodymium-iron-boron rare earth permanent magnetic material in the present invention, the sintered blank is regarded as the pre-sintered alloy material, the nanoscale oxide fine powder is added before the jet mill powder production, the degree of alignment of the magnet is obviously improved, the increase of the oxygen content while grinding powder is reduced, the erosion resistance of the magnet is obviously improved by the added nanoscale oxide fine powder, the performance and the utilization ratio of the material are obviously improved, the use of the rare earth is significantly saved, and especially that of the heavy rare earth, thereby protecting the scare resources. The present invention is adapted for producing the high-performance neodymium-iron-boron rare earth permanent magnetic material.

DETAILED DESCRIPTION OF THE PREFERRED EMBODIMENT

The significant effects of the present invention are further explained with the comparative embodiments as follows.

Embodiment 1

600 kg alloy is respectively selected to melt according to A, B, C and D compositions in Table 1, the alloy is cast on the water-cooled rotating cooling roller in the molten state to cool for forming the alloy sheet, the alloy sheet falls on the rotary table after leaving the rotating copper roller, the rotary table is located below the copper roller, the alloy sheet is secondarily cooled by the inert gas cooling device with the heat exchanger and the mechanical stirring device; the alloy sheet is put into the hanging basket, the basket containing the alloy is sent to the hydrogen absorption chamber, the dehydrogenation heating chamber and the gas cooling chamber of the continuous vacuum hydrogen pulverization furnace in accordance with the order by the hanging drive means for absorbing the hydrogen, heating dehydrogenating and cooling; the powder is prepared by the nitrogen jet mill, the powder size is controlled by the vane sorting wheel, the powder is collected by the cyclone collector, the fine powder discharged by the exhaust pipe of the cyclone collector is collected in the filter, and then under the protection of nitrogen, the fine powder in the filter and the powder collected by the cyclone collector are added into the mixer for mixing; the oxygen content in the jet mill atmosphere is 30 ppm; the magnetic compaction is under the protection of nitrogen, the oxygen content in the protection box is lower than 150 ppm, the compaction temperature is below 5° C., the compact is packaged after magnetic field orientation compaction; the compact with packing is sent to the transfer box with gloves of the protecting feed vacuum sintering furnace, the compact is put into the sintering feed box after the packing of the compact is removed under the protective atmosphere, and then the valve of the protecting feed vacuum sintering furnace is open, the feed box with the compact is automatically sent to the sintering chamber of the protecting feed vacuum sintering furnace by the transfer skip in the transfer box for vacuum or protective atmosphere sintering; the sintering temperature is controlled to 900° C., the pre-sintered alloy material is prepared; the cooled pre-sintered alloy material is put into the hanging basket, the basket containing the alloy is sent to the hydrogen absorption chamber, the dehydrogenation heating chamber and the gas cooling chamber of the continuous vacuum hydrogen pulverization furnace in accordance with the order by the hanging drive means for absorbing the hydrogen, heating dehydrogenating and cooling; the hydrogen pulverized pre-sintered alloy material together with the oxide fine powder shown in Table 2 are put into the two-dimensional mixer for mixing, the average particle size of the powder is 40 nm, the weight content thereof is 0.12%, the mixing time is 40 minutes, the powder is prepared by the jet mill after mixing, the average particle size of the powder in the cyclone collector is 2.4 μm, the fine powder in the filter and the powder collected in the cyclone collector are added to the two-dimensional mixer to mix for 30 minutes under the protection of nitrogen, the oxygen content in the jet mill atmosphere is 40 ppm; the compaction step adopts the magnetic compaction under the protection of nitrogen, the oxygen content in the protective box is 130 ppm, the temperature in the cavity while powder compaction is 3° C., the size of the compact is 50×40×30 mm, the alignment direction is along the direction of 30 dimensions, the compact is packaged after the magnetic field orientation compaction, and then is removed from the protective box for isostatic pressing, and then is sent to the vacuum sintering furnace for sintering and secondary aging treatment, the sintering temperature is 1030° C., the aging temperature are respectively 850° C. and 580° C.; the sample with the size of 10×10×10 mm is used to make the weightlessness experiment for 48 hours, the average weightlessness is 0.7 mg/cm$^2$; the weight of the powder collected by the cyclone collector, the weight of the fine powder collected by the fine powder collector, the species of the fine powder of the added oxide and the data of the magnetic performance thereof are shown in Table 2.

Embodiment 2

600 kg alloy is respectively selected to melt according to E, F, G, H, I and J compositions in Table 1, the alloy is cast on the water-cooled rotating cooling roller in the molten state to cool for forming the alloy sheet, the alloy sheet falls on the rotary table after leaving the rotating copper roller, the alloy sheet is secondarily cooled by the inert gas cooling device with the heat exchanger and the mechanical stirring device after heat preservation for 60 minutes; the cooled alloy sheet is hydrogen pulverized by the rotary vacuum hydrogen pulverization furnace, the alloy is put into the rotary drum, and then the rotary drum is charged with hydrogen after being vacuumed for hydrogen adsorption, when the hydrogen adsorption is saturated, the hydrogen is stopped, and then the drum is vacuumed, heated and rotated for dehydrogenation, the dehydrogenation is made under vacuum, the drum is cooled by argon after dehydrogenation; the powder is prepared by the nitrogen jet mill, the powder size is controlled by the vane sorting wheel, the powder is collected by the cyclone collector, the fine powder discharged by the exhaust pipe of the cyclone collector is collected in the filter, and then under the protection of nitrogen, the fine powder in the filter and the powder collected by the cyclone collector are added into the mixer for mixing; the oxygen content in the jet mill atmosphere is 30 ppm; the magnetic compaction is under the protection of nitrogen, the oxygen content in the protection box is lower than 150 ppm, the compaction temperature is below 5° C., the compact is packaged after magnetic field orientation compaction; the compact with packing is sent to the transfer box with gloves of the protecting feed vacuum sintering furnace, the compact is put into the sintering feed box after the packing of the compact is removed under the protective atmosphere, and then the valve of the protecting feed vacuum sintering furnace is open, the feed box with the compact is automatically sent to the sintering chamber of the protecting feed vacuum sintering furnace by the transfer skip in the transfer box for vacuum or protective atmosphere sintering; the sintering temperature is controlled to 850° C., the pre-sintered alloy material is prepared; the cooled pre-sintered alloy material is put into the hanging basket, the basket containing the alloy is sent to the hydrogen absorption chamber, the dehydrogenation heating chamber and the gas cooling chamber of the continuous vacuum hydrogen pulverization furnace in accordance with the order by the hanging drive means for absorbing the hydrogen, heating dehydrogenating and cooling; the hydrogen pulverized pre-sintered alloy material together with the oxide powder shown in Table 2 are put into the two-dimensional mixer for mixing, the average particle size of the powder is 30 nm, the weight content thereof is 0.09%, the mixing time is 50 minutes, the powder is prepared by the jet mill after mixing, the average particle size of the powder in the cyclone collector is 1.8 μm, the fine powder in the filter and the powder collected in the cyclone collector are added to the two-dimensional mixer to mix for 30 minutes under the protection of nitrogen, the oxygen content in the jet mill atmosphere is 10 ppm; the compaction step adopts the magnetic compaction under the protection of nitrogen, the oxygen content in the protective box is 90 ppm, the temperature in the cavity while powder compaction is 0° C., the size of the compact is 50×40×30 mm, the alignment direction is along the direction of 30 dimensions, the compact is packaged after the magnetic field orientation compaction, and then is removed from the protective box for isostatic pressing, and then is sent to the vacuum sintering furnace for sintering and secondary aging treatment, the sintering temperature is 1040° C., the aging temperature are respectively 950° C. and 530° C.; the sample with the size of 10×10×10 mm is used to make the weightlessness experiment for 48 hours, the average weightlessness is 0.4 mg/cm$^2$; the weight of the powder collected by the cyclone collector, the weight of the fine powder collected by the fine powder collector, the species of the fine powder of the added oxide and the data of the magnetic performance thereof are shown in Table 2.

Embodiment 3

600 kg alloy is respectively selected to melt according to K, L and M compositions in Table 1, the alloy is cast on the water-cooled rotating cooling roller in the molten state to cool for forming the alloy sheet, the alloy sheet falls on the rotary table after leaving the rotating copper roller, the alloy sheet is secondarily cooled by the inert gas cooling device with the heat exchanger and the mechanical stirring device after heat preservation for 60 minutes; the cooled alloy sheet is hydrogen pulverized by the rotary vacuum hydrogen pulverization furnace, the alloy is put into the rotary drum, and then the rotary drum is charged with hydrogen after being vacuumed for hydrogen adsorption, when the hydrogen adsorption is saturated, the hydrogen is stopped, and then the drum is vacuumed, heated and rotated for dehydrogenation, the dehydrogenation is made under vacuum, the drum is cooled by argon after dehydrogenation; the powder is prepared by the nitrogen jet mill, the powder size is controlled by the vane sorting wheel, the powder is collected by the cyclone collector, the fine powder discharged by the exhaust pipe of the cyclone collector is collected in the filter, and then under the protection of nitrogen, the fine powder in the filter and the powder collected by the cyclone collector are added into the mixer for mixing; the oxygen content in the jet mill atmosphere is 30 ppm; the magnetic compaction is under the protection of nitrogen, the oxygen content in the protection box is lower than 150 ppm, the compaction temperature is below 5° C., the compact is packaged after magnetic field orientation compaction; the compact with packing is sent to the transfer box with gloves of the protecting feed vacuum sintering furnace, the compact is put into the sintering feed box after the packing of the compact is removed under the protective atmosphere, and then the valve of the protecting feed vacuum sintering furnace is open, the feed box with the compact is automatically sent to the sintering chamber of the protecting feed vacuum sintering furnace by the transfer skip in the transfer box for vacuum or protective atmosphere sintering; the sintering temperature is controlled to 880° C., the pre-sintered alloy material is prepared; the cooled pre-sintered alloy material is put into the hanging basket, the basket containing the alloy is sent to the hydrogen absorption chamber, the dehydrogenation heating chamber and the gas cooling chamber of the continuous vacuum hydrogen pulverization furnace in accordance with the order by the hanging drive means for absorbing the hydrogen, heating dehydrogenating and cooling; the hydrogen pulverized pre-sintered alloy material together with the oxide powder shown in Table 2 are put into the two-dimensional mixer for mixing, the average particle size of the powder is 20 nm, the weight content thereof is 0.12%, the mixing time is 50 minutes, the powder is prepared by the jet mill after mixing, the average particle size of the powder in the cyclone collector is 1.3 μm, the fine powder in the filter and the powder collected in the cyclone collector are added to the two-dimensional mixer to mix for 30 minutes under the protection of nitrogen, the oxygen content in the jet mill atmosphere is 10 ppm; the compaction step adopts the magnetic field compaction under the protection of nitrogen, the oxygen content in the protective box is 90 ppm, the temperature in the cavity while powder compaction is 0° C., the size of the compact is 50×40×30 mm, the alignment direction is along the direction of 30 dimensions, the compact is packaged after the magnetic field orientation compaction, and then is removed from the protective box for isostatic pressing, and then is sent to the vacuum sintering furnace for sintering and secondary aging treatment, the sintering temperature is 1010° C., the aging temperature are respectively 900° C. and 450° C.; the sample with the size of 10×10×10 mm is used to make the weightlessness experiment for 48 hours, the average weightlessness is 0.3 mg/cm$^2$; the weight of the powder collected by the cyclone collector, the weight of the fine powder collected by the fine powder collector, the species of the fine powder of the added oxide and the data of the magnetic performance thereof are shown in Table 2.

TABLE 1

The composition of the alloy

| No. | Serial number | Composition |
|---|---|---|
| 1 | A | Nd30Dy1Fe67.9B0.9Al0.2 |
| 2 | B | Nd30Dy1Fe67.5Co1.2Cu0.1B0.9Al0.1 |
| 3 | C | Nd25Dy5Fe66.3Co2.4Cu0.2B0.9Al0.2 |
| 4 | D | Nd24Dy5Fe65.9Co3.6Cu0.3B0.9Al0.3 |
| 5 | E | (Pr0.2Nd0.8)25Dy5Fe67.4Co1.2Cu0.3B0.9Al0.2 |
| 6 | F | (Pr0.2Nd0.8)25Dy5Tb1Fe65Co2.4Cu0.3B0.9Al0.2Ga0.1Zr0.1 |
| 7 | G | (Pr0.2Nd0.8)22Dy5Gd2Ho2Fe63.8Co3.6Cu0.2B0.9Al0.4Ga0.1 |
| 8 | H | (Pr0.2Nd0.8)23Dy5Ho2Fe64.7Co3.6Cu0.2B0.9Al0.4Ga0.1Nb0.1 |
| 9 | I | (Pr0.25Nd0.75)25Dy5Fe65.9Co2.4Cu0.3B0.9Al0.4Ga0.1 |
| 10 | J | (Pr0.25Nd0.75)21Dy10Fe62.2Co4.8Cu0.3B1.1Al0.4Ga0.1Zr0.1 |
| 11 | K | (Pr0.2Nd0.8)27Dy2Gd2Fe63.7Co3.6Cu0.3B1.1Al0.2Ga0.1 |
| 12 | L | (Pr0.2Nd0.8)27Dy2Ho2Fe62.4Co4.8Cu0.3B1.0Al0.2Ga0.2Zr0.1 |
| 13 | M | (Pr0.2Nd0.8)21Dy10Fe60.9Co6Cu0.3B1Al0.2Ga0.3Zr0.2Nb0.1 |

TABLE 2

The measurement results of the magnetic performance of the magnet of the present invention

| No. | Serial Number | Weight of powder (Kg) | Weight of fine powder (Kg) | Species of oxygen fine powder | Magnetic energy product (MGOe) | Remanence (Gs) | Coercivity (Oe) |
|---|---|---|---|---|---|---|---|
| 14 | A | 539 | 35 | $La_2O_3$ | 49.3 | 14812 | 19753 |
| 15 | B | 548 | 30 | $Y_2O_3$ | 48.5 | 14980 | 19640 |
| 16 | C | 547 | 35 | $Fe_2O_3$ | 39.6 | 13580 | 30570 |
| 17 | D | 545 | 30 | $TiO_2$ | 39.8 | 13130 | 30360 |
| 18 | E | 534 | 40 | $Pr_2O_3$ | 38.7 | 12540 | 30720 |
| 19 | F | 539 | 40 | $Al_2O_3$ | 39.7 | 12980 | 30960 |
| 20 | G | 536 | 45 | $ZnO_2$ | 36.8 | 12690 | 30850 |
| 21 | H | 538 | 45 | $ZrO_2$ | 37.9 | 12480 | 32360 |
| 22 | I | 545 | 43 | $Al_2O_3$ | 38.7 | 12700 | 30630 |
| 23 | J | 545 | 45 | $CeO_2$ | 33.6 | 12350 | 33850 |
| 24 | K | 516 | 68 | $Nd_2O_3$ | 39.9 | 13640 | 26640 |
| 25 | L | 519 | 63 | $Dy_2O_3$ | 39.6 | 13375 | 26910 |
| 26 | M | 514 | 65 | $La_2O_3$ + $Y_2O_3$ + $TiO_2$ | 34.8 | 12490 | 34820 |

TABLE 3

The measurement results of the magnetic performance of the magnet of the comparative examples

| No. | Serial number | Weight of powder (Kg) | Weight of fine powder (Kg) | Species of oxygen fine powder | Magnetic Energy Product (MGOe) | Remanence (Gs) | Coercivity (Oe) |
|---|---|---|---|---|---|---|---|
| 27 | A | 542 | 0 | — | 47.3 | 13963 | 14553 |
| 28 | B | 545 | 0 | — | 46.2 | 14009 | 14420 |
| 29 | C | 546 | 0 | — | 37.5 | 12398 | 25340 |
| 30 | D | 545 | 0 | — | 37.6 | 12563 | 26560 |
| 31 | E | 547 | 0 | — | 37.2 | 12395 | 25370 |
| 32 | F | 545 | 0 | — | 37.5 | 12563 | 26550 |
| 33 | G | 553 | 0 | — | 34.6 | 11837 | 26320 |
| 34 | H | 544 | 0 | — | 34.8 | 12078 | 26070 |
| 35 | I | 545 | 0 | — | 36.5 | 12260 | 26060 |
| 36 | J | 535 | 0 | — | 31.9 | 11460 | 29330 |
| 37 | K | 535 | 0 | — | 37.7 | 12396 | 21356 |
| 38 | L | 538 | 0 | — | 36.6 | 12280 | 21769 |
| 39 | M | 537 | 0 | — | 32.8 | 11370 | 29040 |

Comparative Example 1

600 kg alloy is respectively selected to melt according to A, B, C and D compositions in Table 1, the alloy is cast on the water-cooled rotating cooling roller in the molten state to cool for forming the alloy sheet, the alloy sheet falls on the rotary table after leaving the rotating copper roller, the rotary table is located below the copper roller, the alloy sheet is secondarily cooled by the inert gas cooling device with the heat exchanger and the mechanical stirring device; the alloy sheet is put into the hanging basket, the basket containing the alloy is sent to the hydrogen absorption chamber, the dehydrogenation heating chamber and the gas cooling chamber of the continuous vacuum hydrogen pulverization furnace in accordance with the order by the hanging drive means for absorbing the hydrogen, heating dehydrogenating and cooling; the powder is prepared by the nitrogen jet mill, the powder size is controlled by the vane sorting wheel, the powder is collected by the cyclone collector; the oxygen content in the jet mill atmosphere is 30 ppm; the particle size of the powder prepared by the jet mill is controlled to 3.2 μm, the compaction process is the magnetic compaction under the protection of nitrogen, the oxygen content in the protection box is 130 ppm, the temperature in the cavity while powder compaction is 3° C., the size of the compact is 50×40×30 mm, the alignment direction is along the direction of 30 dimensions, the compact is packaged after the magnetic field orientation compaction, and then is removed from the protective box for isostatic pressing, and then is sent to the vacuum sintering furnace for sintering and secondary aging treatment, the sintering temperature is 1030° C., the aging temperature are respectively 850° C. and 580° C.; the sample with the size of 10×10×10 mm is used to make the weightlessness experiment for 48 hours, the average weightlessness is 4.6 mg/cm$^2$; the measurement results of the magnetic performance are shown in Table 3.

Comparative Example 2

600 kg alloy is respectively selected to melt according to E, F, G, H, I and J compositions in Table 1, the alloy is cast on the water-cooled rotating cooling roller in the molten state to cool for forming the alloy sheet, the alloy sheet falls on the rotary table after leaving the rotating copper roller, the alloy sheet is secondarily cooled by the inert gas cooling device with the heat exchanger and the mechanical stirring device after heat preservation for 60 minutes; the cooled alloy sheet is hydrogen pulverized by the rotary vacuum hydrogen pulverization furnace, the alloy is put into the rotary drum, and then the rotary drum is charged with hydrogen after being vacuumed for hydrogen adsorption, when the hydrogen adsorption is saturated, the hydrogen is stopped, and then the drum is vacuumed, heated and rotated for dehydrogenation, the dehydrogenation is made under vacuum, the drum is cooled by argon after dehydrogenation; the powder is prepared by the nitrogen jet mill, the powder size is controlled by the vane sorting wheel, the powder is collected by the cyclone collector; the oxygen content in the jet mill atmosphere is 10 ppm; the compaction process is the magnetic compaction under the protection of nitrogen, the oxygen content in the protection box is 90 ppm, the temperature in the cavity while powder compaction is 0° C., the size of the compact is 50×40×30 mm, the alignment direction is along the direction of 30 dimensions, the compact is packaged after the magnetic field orientation compaction, and then is removed from the protection box for isostatic pressing, and then is sent to the vacuum sintering furnace for sintering and secondary aging treatment, the sintering temperature is 1040° C., the aging temperature are respectively 950° C. and 530° C.; the sample with the size of 10×10×10 mm is used to make the weightlessness experiment for 48 hours, the average weightlessness is 3.3 mg/cm$^2$; the measurement results of the magnetic performance are shown in Table 3.

Comparative Example 3

600 kg alloy is respectively selected to melt according to K, L and M compositions in Table 1, the alloy is cast on the water-cooled rotating cooling roller in the molten state to cool for forming the alloy sheet, the alloy sheet falls on the rotary table after leaving the rotating copper roller, the alloy sheet is secondarily cooled by the inert gas cooling device with the heat exchanger and the mechanical stirring device after heat preservation for 60 minutes; the cooled alloy sheet is hydrogen pulverized by the rotary vacuum hydrogen pulverization furnace, the alloy is put into the rotary drum, and then the rotary drum is charged with hydrogen after being vacuumed for hydrogen adsorption, when the hydrogen adsorption is saturated, the hydrogen is stopped, and then the drum is vacuumed, heated and rotated for dehydrogenation, the dehydrogenation is made under vacuum, the drum is cooled by argon after dehydrogenation; the powder is prepared by the nitrogen jet mill, the powder size is controlled by the vane sorting wheel, the powder is collected by the cyclone collector; the oxygen content in the jet mill atmosphere is 30 ppm; the particle size of the powder made by the jet mill is controlled to 3.2 μm, the compaction process is the magnetic compaction under the protection of nitrogen, the oxygen content in the protection box is 90 ppm, the temperature in the cavity while powder compaction is 0° C., the size of the compact is 50×40×30 mm, the alignment direction is along the direction of 30 dimensions, the compact is packaged after the magnetic field orientation compaction, and then is removed from the protection box for isostatic pressing, and then is sent to the vacuum sintering furnace for sintering and secondary aging treatment, the sintering temperature is 1010° C., the aging temperature are respectively 900° C. and 450° C.; the sample with the size of 10×10×10 mm is used to make the weightlessness experiment for 48 hours, the average weightlessness is 2.6 mg/cm$^2$; the measurement results of the magnetic performance are shown in Table 3.

The above-mentioned embodiments show that the degree of alignment of the magnet can be improved by preparing the pre-sintered alloy material, the fine powder in the filter of the jet mill can be added to the powder collected by the cyclone collector by controlling the oxygen content of the jet mill and adding the nanoscale oxide fine powder, and the performance of the magnet can be improved by controlling the technical parameters of the process. The present invention can significantly improve the utilization ratio of the material, save the use of the rare earth, and especially that of the heavy rare earth, and improve the coercivity and the magnetic energy product of the rare earth permanent magnet and the corrosion resistance of the magnet in the premise of saving the rare earth. It is the method for producing the high-performance neodymium-iron-boron rare earth permanent magnetic material and is beneficial to protect the scare resources.

What is claimed is:

1. A method for producing a high-performance neodymium-iron-boron rare earth permanent magnetic material, comprising steps of: firstly alloy melting, pulverizing, jet mill powder producing, magnetically compacting and sintering to prepare a pre-sintered alloy material, secondarily hydrogen pulverizing the pre-sintered alloy material, evenly mixing the hydrogen pulverized pre-sintered alloy material with at least one nanoscale oxide fine powder, and then secondarily powder producing, secondarily magnetic compacting, secondarily sintering, machining and aging for producing the neodymium-iron-boron permanent magnetic material.

2. The method, as recited in claim 1, wherein the pre-sintered alloy material is prepared as follows:

(1) the step of alloy melting adopts a vacuum induction melting, which comprises casting the alloy on a water-cooled rotating cooling roller in a molten state to cool for forming an alloy sheet, the alloy sheet falling on a rotary table after leaving the rotating cooling roller, wherein the rotary table is located below the cooling roller, and secondarily cooling the alloy sheet by an inert gas cooling device with a heat exchanger and a mechanical stirring device;

(2) the step of pulverizing comprises putting the alloy sheet into a hanging basket, sending the basket containing the alloy to a hydrogen absorption chamber, a dehydrogenation heating chamber and a gas cooling chamber of a continuous vacuum hydrogen pulverization furnace sequentially by a hanging drive means for absorbing the hydrogen, heating dehydrogenating and cooling, and then putting the alloy into a material storage tank under a vacuum or protective atmosphere;

(3) the step of jet mill powder producing utilizes a nitrogen jet mill to prepare the powder, which comprises controlling a powder size by a vane sorting wheel, collecting the powder by a cyclone collector, collecting a fine powder discharged by an exhaust pipe of the cyclone collector in a filter, and then under a protection of nitrogen, adding the fine powder in the filter and the powder collected by the cyclone collector into a mixer for mixing; wherein an oxygen content in a jet mill atmosphere is lower than 50 ppm;

(4) the step of magnetically compacting is the magnetic compaction under the protection of nitrogen, wherein an oxygen content in a protection box is lower than 150 ppm, a compaction temperature is below 5° C., a compact is packaged after magnetic field orientation compaction; and (5) the step of sintering comprises sending the compact with packing to a transfer box with gloves of a protecting feed vacuum sintering furnace, putting the compact into a sintering feed box after the packing of the compact is removed under a protective atmosphere, and then opening a valve of the protecting feed vacuum sintering furnace, automatically sending the sintering feed box with the compact to a sintering chamber of the protecting feed vacuum sintering furnace by a transfer skip in the transfer box for vacuum or protective atmosphere sintering; wherein a sintering temperature is controlled to 850-900° C.

3. The method, as recited in claim 1, wherein the step of secondarily hydrogen pulverizing comprises putting an alloy sheet into a hanging basket, sending the basket containing the alloy to a hydrogen absorption chamber, a dehydrogenation heating chamber and a gas cooling chamber of a continuous vacuum hydrogen pulverization furnace sequentially by a hanging drive means for absorbing the hydrogen, heating dehydrogenating and cooling, and then putting the alloy into a material storage tank under the vacuum or protective atmosphere.

4. The method, as recited in claim 1, wherein the nanoscale oxide fine powder is one or more fine powders selected from the group consisting of cerium oxide, praseodymium oxide, neodymium oxide, dysprosium oxide, zinc oxide, aluminum oxide and zirconium oxide.

5. The method, as recited in claim 1, wherein the step of secondarily powder producing comprises firstly evenly mixing the secondarily hydrogen pulverized powder material with the nanoscale oxide fine powder, and then preparing the powder by the jet mill, wherein the step of preparing the powder by the jet mill comprises controlling a powder size by a vane sorting wheel, collecting the powder by a cyclone collector, collecting a fine powder discharged by an exhaust pipe of the cyclone collector in a filter, and then under the protection of nitrogen, adding the fine powder in the filter and the powder collected by the cyclone collector into a mixer for mixing; wherein an oxygen content in a jet mill atmosphere is lower than 50 ppm.

6. The method, as recited in claim 4, wherein the step of secondarily powder producing comprises firstly evenly mixing the secondarily hydrogen pulverized powder material with the nanoscale oxide fine powder, and then preparing the powder by the jet mill, wherein the step of preparing the powder by the jet mill comprises controlling a powder size by a vane sorting wheel, collecting the powder by a cyclone collector, collecting a fine powder discharged by an exhaust pipe of the cyclone collector in a filter, and then under the protection of nitrogen, adding the fine powder in the filter and the powder collected by the cyclone collector into a mixer for mixing; wherein an oxygen content in a jet mill atmosphere is lower than 50 ppm.

7. The method, as recited in claim 1, wherein the step of secondarily magnetic compacting is the magnetic compaction under the protection of nitrogen, an oxygen content in a protection box is lower than 150 ppm, a compaction temperature is 5° C., and a compact is packaged after magnetic field orientation compaction, and then is removed from a protection box for isostatic pressing.

8. The method, as recited in claim 1, wherein the step of secondarily sintering comprises under a condition of isolating from an atmosphere after isostatic pressing, sending a compact with packing to a transfer box with gloves of a protecting feed vacuum sintering furnace, putting the compact into a sintering feed box after the packing of the compact is removed under a protective atmosphere, and then opening a valve of the protecting feed vacuum sintering furnace, automatically sending a feed box with the compact to a sintering chamber of the protecting feed vacuum sintering furnace by a transfer skip in the transfer box for vacuum or protective atmosphere sintering; wherein a sintering temperature is controlled to 950-1050° C.

9. The method, as recited in claim 1, wherein the step of machining and aging comprises machining a sintered compact according to a final size or approximately final size of a piece, and applying a high-temperature aging treatment and a low temperature aging treatment to the compact after machining; wherein a high-temperature aging temperature is 850-950° C., a low-temperature aging temperature is 450-650° C.

10. The method, as recited in claim 1, wherein an average particle size of the nanoscale oxide fine powder is 20-40 nm.

11. The method, as recited in claim 1, wherein the step of pulverizing and secondarily hydrogen pulverizing comprises putting the alloy into a rotary drum, and then charging the rotary drum with hydrogen after being vacuumed for hydrogen adsorption, stopping charging the hydrogen when the hydrogen adsorption is saturated, and then vacuuming the drum, heating and rotating for dehydrogenation, making the dehydrogenation under vacuum, and cooling the drum after dehydrogenation.

* * * * *